US006405708B1

(12) United States Patent
Watson

(10) Patent No.: US 6,405,708 B1
(45) Date of Patent: Jun. 18, 2002

(54) DUAL IGNITION SYSTEM WITH TIMING OFFSETS FOR OPPOSED PISTON ENGINE

(76) Inventor: Christopher L. Watson, 331 Twin Lakes Rd., Rock Hill, SC (US) 29732

( * ) Notice: Subject to any disclaimer, the term of this patent is extended or adjusted under 35 U.S.C. 154(b) by 0 days.

(21) Appl. No.: 09/784,366

(22) Filed: Feb. 15, 2001

(51) Int. Cl.[7] ..... F02P 5/00
(52) U.S. Cl. ..... 123/406.6; 123/406.62
(58) Field of Search ..... 123/406.6, 406.61, 123/406.62

(56) References Cited

U.S. PATENT DOCUMENTS 4,250,846 A * 2/1981 Menard ..... 123/406.61
5,549,091 A * 8/1996 Tsunoda et al. ..... 123/406.6
5,671,145 A * 9/1997 Krebs et al. ..... 123/406.62
5,794,592 A * 8/1998 Fukui ..... 123/406.62
6,016,789 A * 1/2000 Denz et al. ..... 123/406.62
6,035,826 A * 3/2000 Matsuoka ..... 123/406.62
6,279,519 B1 * 8/2001 Nagel et al. ..... 123/55.5

* cited by examiner

*Primary Examiner*—Erick Solis
(74) *Attorney, Agent, or Firm*—John V. Stewart

(57) ABSTRACT

A dual ignition system for a truly opposed piston engine providing offsets from the standard timing separation, which is 1440 degrees divided by the number of pistons. Timing is obtained from a timing mark on the flywheel. An ignition transformer is provided on each cylinder. Each transformer has two output coils, and fires two cylinders on the same side of the engine that are separated by 360 degrees of timing plus or minus the offset. A cam position disk is provided on a camshaft of the engine. Half of its circumference is marked sensibly differently from the other half. A cam position sensor adjacent this disk provides input to a logic circuit that determines which of the two adjacent offset timings to send to each transformer depending on which half of the 720-degree engine cycle is in effect.

4 Claims, 5 Drawing Sheets

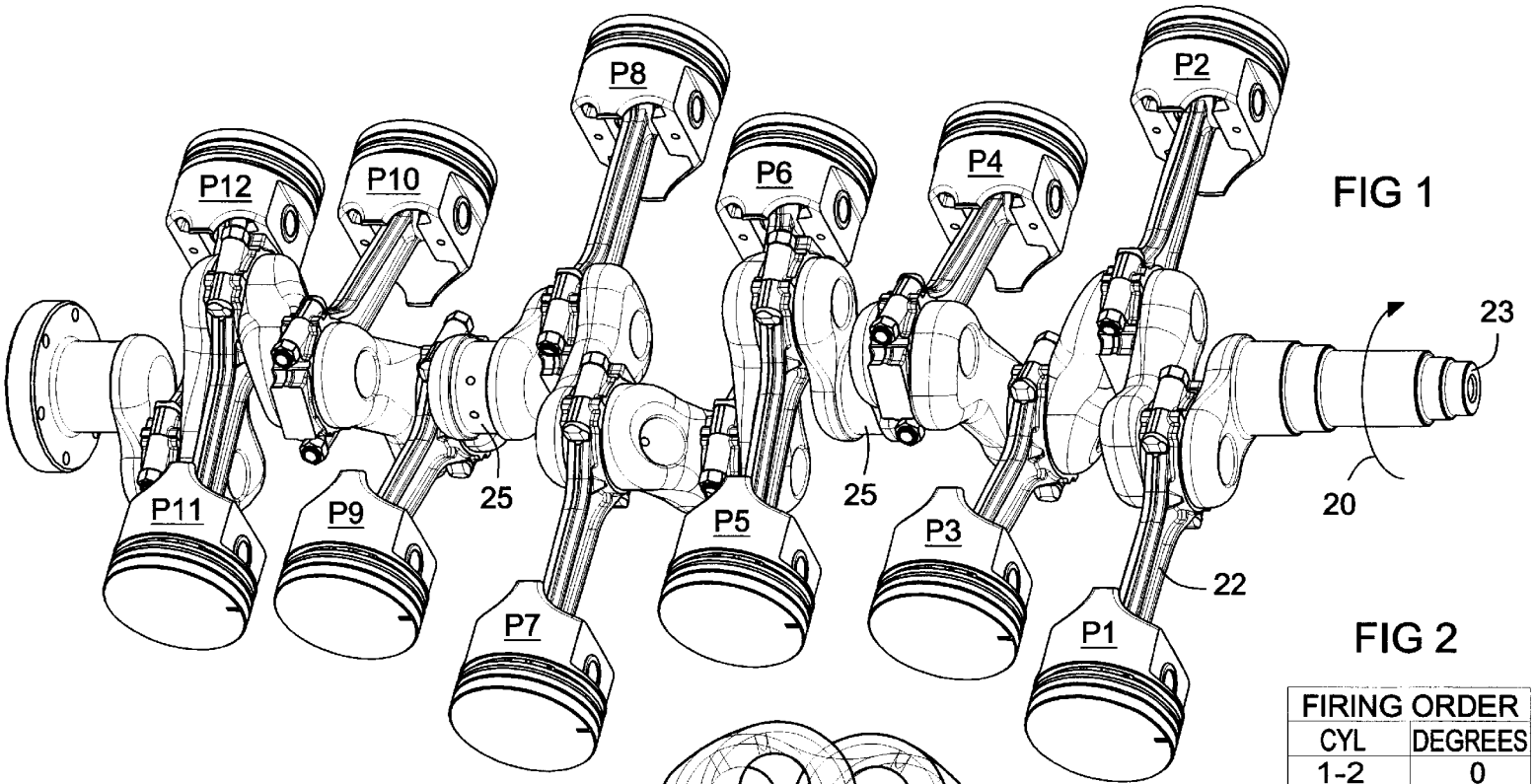
FIG 1
| FIRING ORDER | |
|---|---|
| CYL | DEGREES |
| 1-2 | 0 |
| 3-4 | 105 |
| 5-6 | 240 |
| 7-8 | 345 |
| 9-10 | 480 |
| 11-12 | 585 |
FIG 2
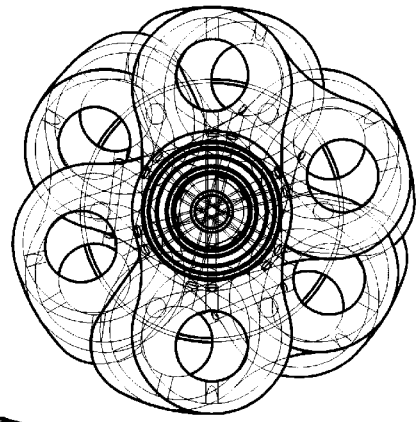
FIG 3

DUAL IGNITION SYSTEM WITH TIMING OFFSETS FOR OPPOSED PISTON ENGINE

BACKGROUND OF THE INVENTION

1. Field of the Invention

This invention relates to ignition systems for internal combustion piston engines.

2. Description of Prior Art

Piston engines for aircraft often have two independent ignition systems so an engine will continue to operate if one ignition system fails. This includes two spark plugs per cylinder, with a separate alternator, coils, distribution components, and timing sensing components for each set of plugs.

A piston engine in which both cylinders in each pair of opposed cylinders fire simultaneously is called "truly-opposed". A new design for a 12-cylinder 4-cycle truly opposed piston engine was developed by William S. Nagel and Philip L. Reid, and is the subject of a separate patent application. Chris Watson is a consultant to the inventors of that engine, and is the inventor of the ignition system described herein.

The preferred crankshaft and timing table for the Nagel/Reid engine is shown in FIGS. 1–3 herein. This engine uses a dual Ignition transformer mounted above each cylinder on the cylinder head. Each dual ignition transformer has two secondary windings and provides two spark output leads. The first spark lead fires one of two sparkplugs in the cylinder on which the coil is mounted, and the second spark plug lead simultaneously fires one of two sparkplugs in the opposed cylinder on the opposite side of the engine. Thus, the second spark output lead must cross over the engine.

A conventional truly-opposed engine fires the cylinders on multiples of 1440 degrees divided by the number of cylinders. For example, in a 12-cylinder engine, two opposed cylinders fire at each 120 degrees of engine rotation. For practical reasons, ignition timing for such an engine is normally obtained by multiply sensing a timing mark on a disk attached to the crankshaft. A 4-cycle engine rotates 720 degrees for each complete 4-stroke cycle, and timing signals are distributed over 720 degrees. A timing disk rotating with the crankshaft also rotates 720 degrees per full cycle. Thus, timing signals for the first 360 degrees of the ignition sequence overlay timing signals for the second 360 degrees. For example, the 0-degree signal is the same as the 360-degree signal, even though a different pair of cylinders is to be fired at 0 degrees and at 360 degrees.

The ambiguity caused by this timing overlay has been previously handled by sending the same distributor output voltage to two coils at each rotation of the timing mark. For example, the pair of cylinders to be fired at 0 degrees, and the pair of cylinders to be fired at 360 degrees are both sparked at both times. This provides a spark twice as often as needed in each cylinder. However, at each spark time only one of the two pairs of cylinders is on the compression stroke and is fired by the spark. The second pair of cylinders is either on the end of the exhaust stroke or the beginning of the intake stroke, and the spark is wasted. When the second pair of cylinders is on the compression stroke, both pairs of cylinders are sparked again, firing the second pair of cylinders. This solution avoids the need to distinguish between timing marks 360 degrees apart in the 720-degree timing cycle. It also halves the number of distributor outputs that would otherwise be needed for a separate spark to each pair of cylinders.

However, this convenient solution is not available in the preferred Nagel/Reid engine, because Nagel/Reid discovered that providing an alternating positive and negative offset to the timing sequence reduces harmonic vibrations in the crankshaft. Instead of using a spark every 120 degrees, the Nagel/Reid engine uses timing shown in FIG. 2 as an example. Other timing variations may be used in this concept. The essence is that positive and negative offsets balance, so the average timing separation between pairs of cylinders is still 1440 degrees divided by the number of cylinders. It doesn't matter if the first offset is positive or negative.

In an engine with timing offsets, the piston cranks are also offset to match, as shown in FIGS. 1 and 3. The spark is still provided at the same optimum point in the compression stroke of each cylinder. For ignition timing with offsets, the ignition distributor must determine which pair of cylinders is in compression. The present invention provides a way of making this distinction.

SUMMARY OF THE INVENTION

An objective of the present invention is provision of ignition system timing for a truly opposed 4-cycle piston engine in which the ignition timing sequence is in steps of 1440 degrees divided by the number of cylinders plus an alternating positive/negative offset. A second objective is to obtain the ignition timing by sensing marks on a timing disk rotating at the speed of the crankshaft. A third objective is to use a low voltage electronic distributor, ignition coils mounted on the cylinder heads, and spark plug leads that do not cross over the engine. A fourth objective is to minimize the number of transformers and the number of wires between the distributor and the transformers, making dual redundant ignition systems practical.

These objectives are achieved by:

a) providing a cam sensor disk connected to a camshaft of the engine, the cam sensor disk having a circumference, with a first half of the circumference differentiated from the second half for sensing;

b) providing an ignition timing disk connected to the crankshaft of the engine, the timing disk having a circumference with a timing mark;

c) providing sensors for sensing the timing mark, the sensors located in a sequence around the circumference of the timing disk, starting at 0 degrees, in steps of 1440 degrees divided by the number of cylinders of the engine plus an offset that alternates between positive and negative;

d) providing an electronic distributor with an output lead for each two cylinders on the same side of the engine that are fired by respective two adjacent sensors separated by the magnitude of the offset on the timing disk; and, e) on each 360-degree rotation of the timing disk, selecting which of said respective two adjacent sensors to enable for said each two cylinders based on the position of the cam sensor disk;

whereby the spark timing for each cylinder alternates between two timings, a first timing to fire the cylinder, and a second timing to fire a second cylinder on the same side of the engine using the same distributor output lead.

BRIEF DESCRIPTION OF THE DRAWINGS

FIG. 1 is a perspective view of a crank shaft and pistons for a truly opposed 12-cylinder engine according to Nagel/Reid.

FIG. 2 is a firing order table for the crank of FIG. 1.

FIG. 3 is a front transparent view of the crank of FIG. 1.

REFERENCE NUMBERS

Figure 4A:
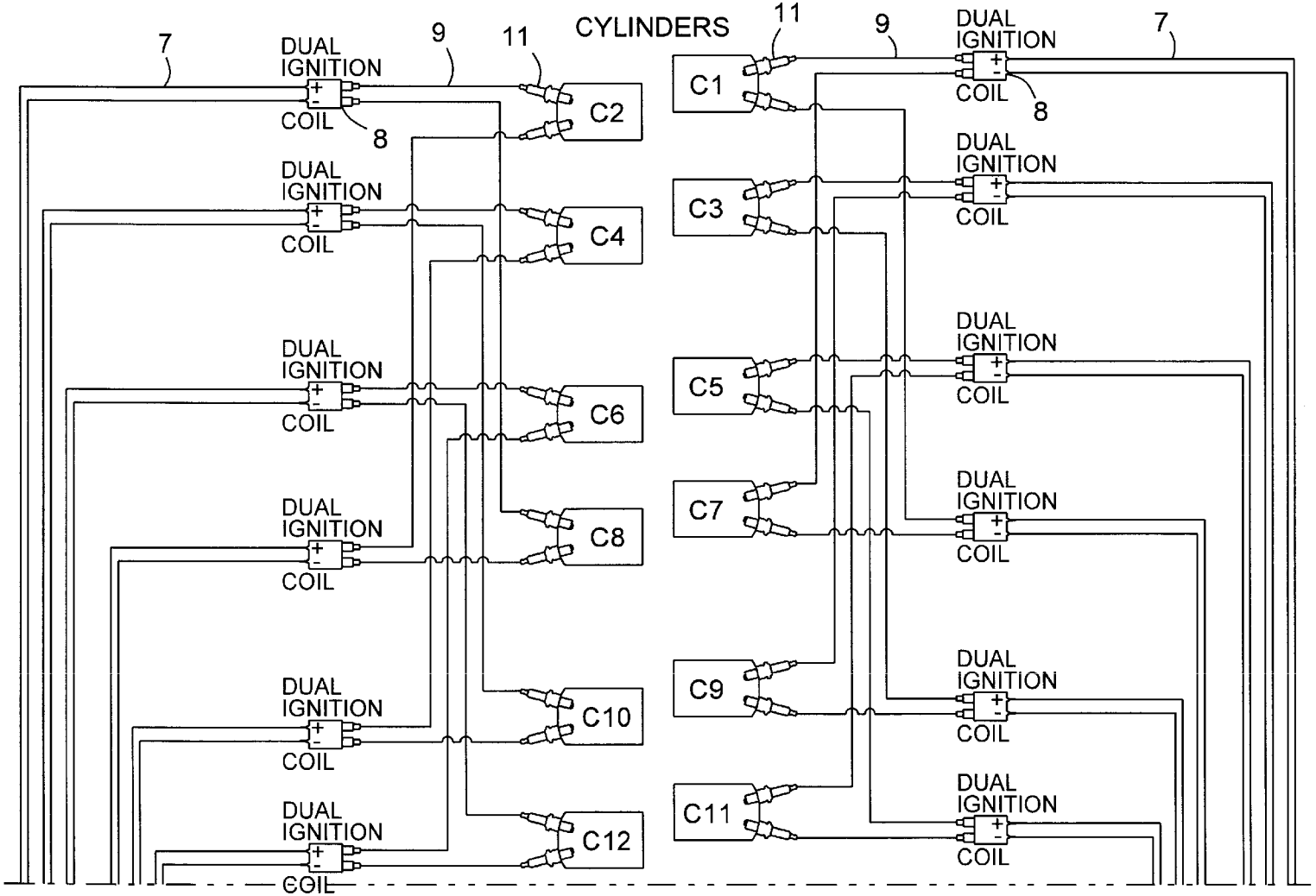
FIG. 4A is part A of an ignition system schematic diagram for the crank and ignition timing of FIGS. 1–3 according to the present invention.
Figure 4B:
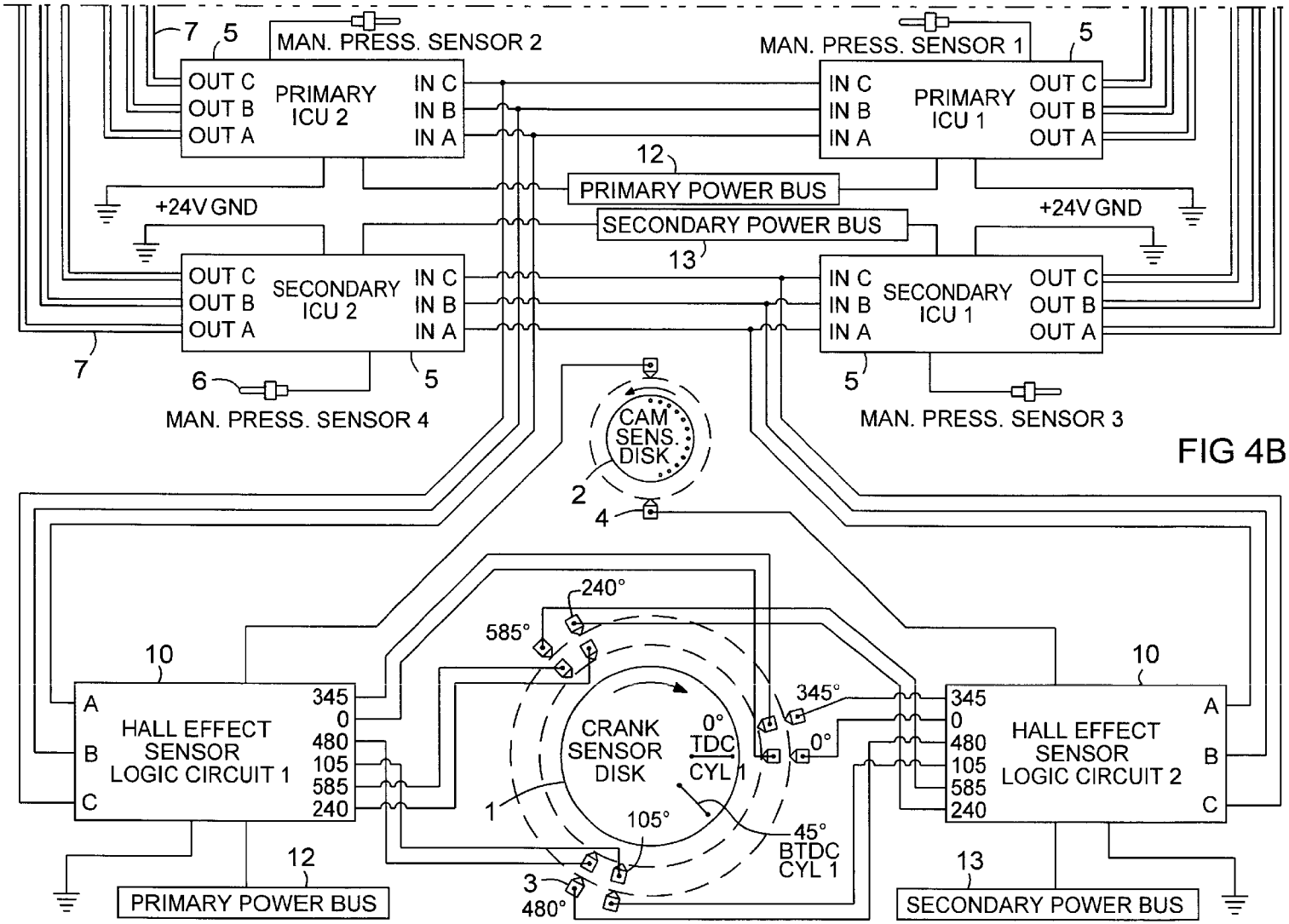
FIG. 4B is part B of FIG. 4A.
Figure 5A:
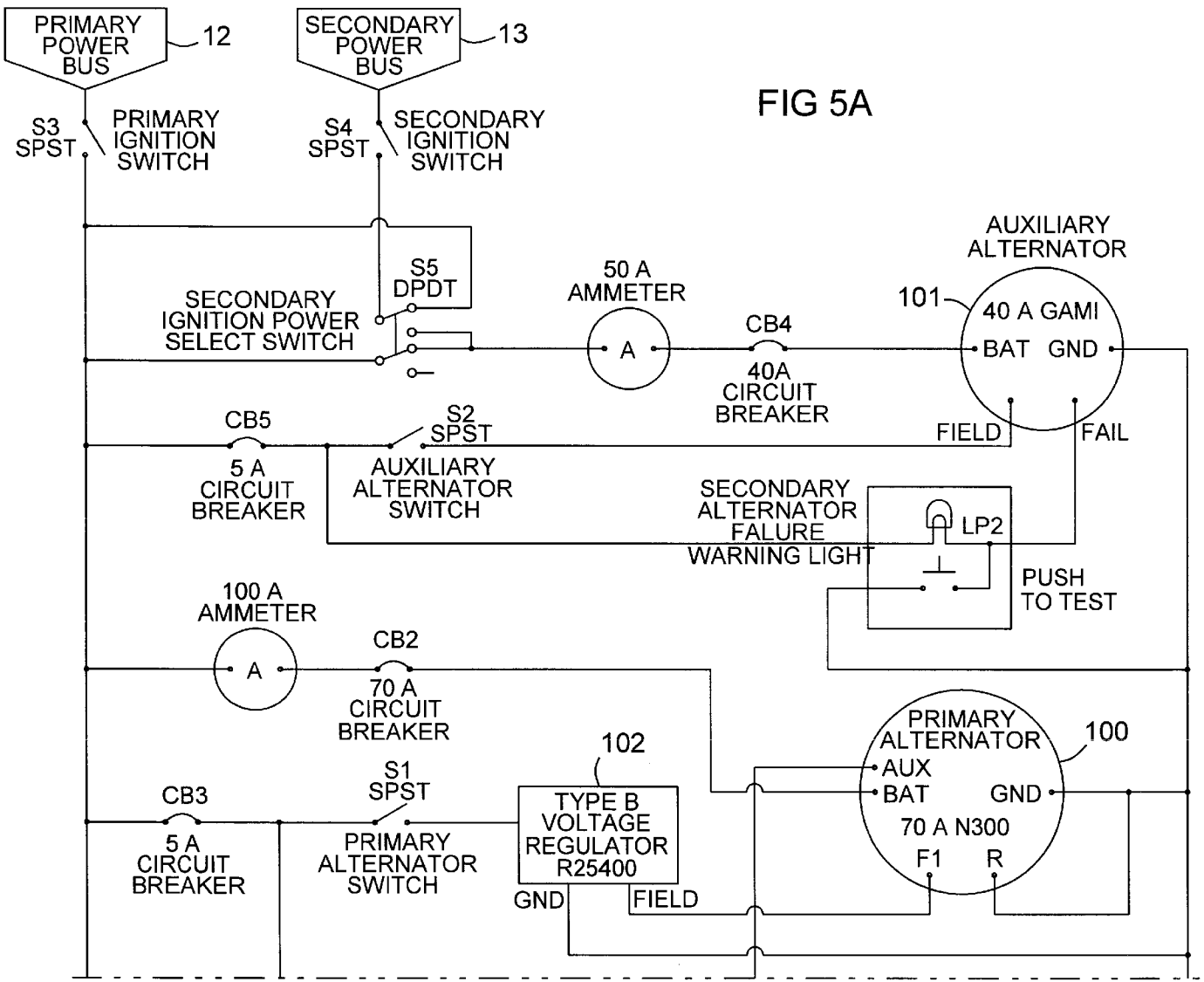
FIG. 5A is part A of an electrical system schematic diagram appropriate for the invention.
Figure 5B:
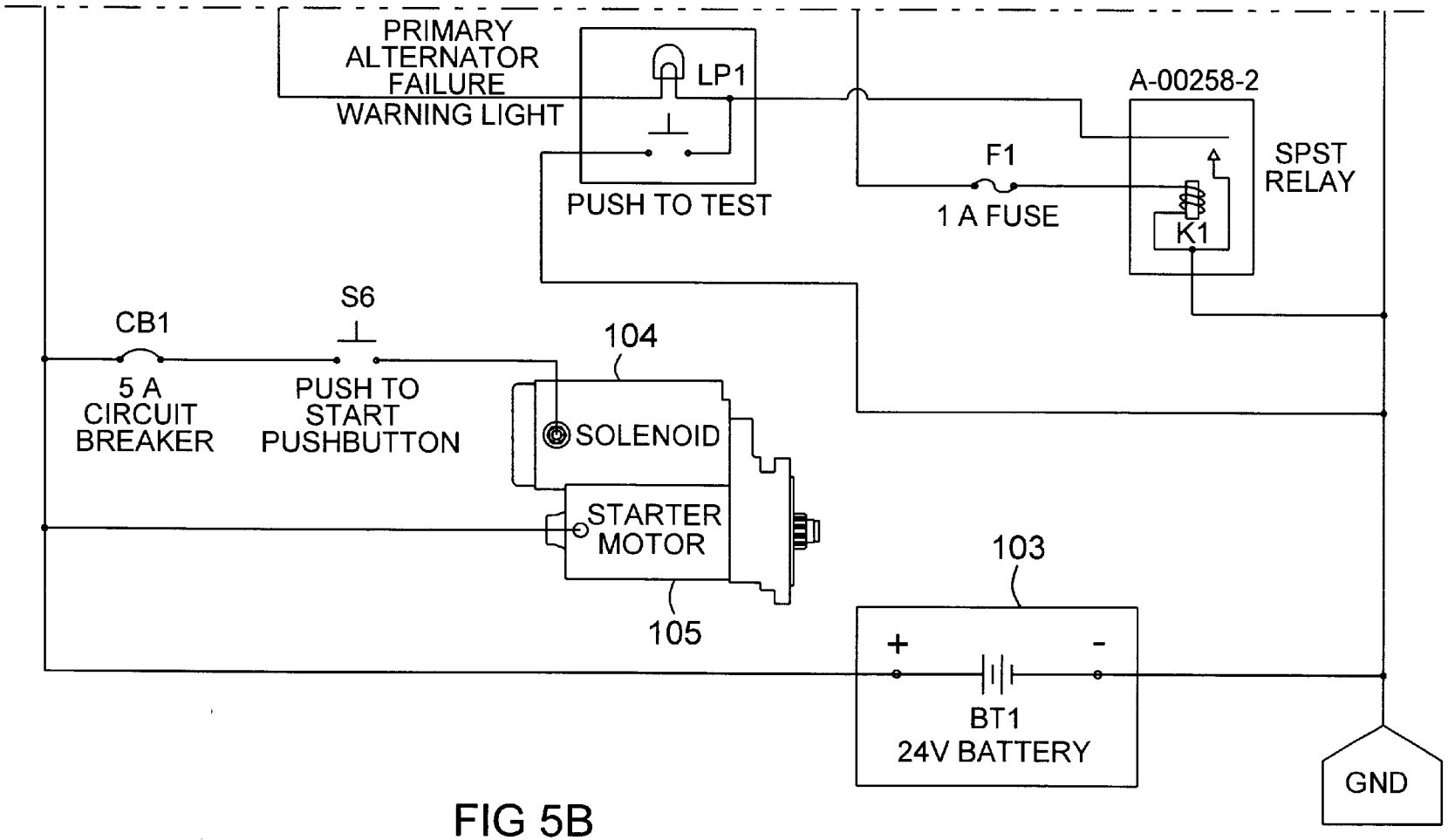
FIG. 5B is part B of FIG. 5A.

P1–P12. Pistons 1–12
C1–C12. Cylinders 1–12

1. Timing disk on crankshaft, normally the flywheel
2. Cam position disk
3. Crankshaft timing sensor
4. Cam position sensor
5. Ignition control unit (electronic distributor)
6. Manifold pressure sensor
7. Ignition wire
8. Dual ignition transformer or coil
9. Spark plug lead
10. Hall effect logic circuit
11. Spark plug
12. Primary power bus
13. Secondary power bus
20. Direction of crankshaft rotation
22. Piston connecting rod
23. Crankshaft
25. Bearing journal
100. Primary alternator
101. Auxiliary alternator
102. Voltage regulator
103. Battery
104. Solenoid
105. Starter motor

DETAILED DESCRIPTION

The invention is a new type of ignition system for a 12 cylinder piston engine of the truly-opposed type. This is an engine with pairs of opposed cylinders that fire at the same time, rather than on opposite cycles. The crankshaft timing for this engine is unique. In order to reduce harmonic vibrations in the crankshaft a staggered timing is employed by inventors NageVReid in which the timing separation between firings alternates between 105 and 135 degrees rather than using the typical constant separation of 120 degrees.

Cylinders 1 and 7 fire on opposite cycles of the engine—as do 2 and 8, 3 and 9, 4 and 10, 5 and 11, 6 and 12. If a Dual Ignition Coil were used to drive the above cylinders that fire on opposite cycles, then fairly short spark plug leads could be used which would run along the side of the engine, and would not cross over the engine. The design of the engine lends itself well to routing the wires in this manner.

However, due to the staggered timing scheme, there is a 15 degree difference between the top dead centers of these cylinders. Thus, firing each of the above pairs of cylinders together would not work, since one or the other of the two cylinders would be mistimed by 15 degrees.

To make the above method work, the timing must shift 15 degrees back and forth between cycles. To accomplish this, a cam position sensor on a cam position disk determines the position of the engine in its 4-stroke cycle. The cam position sensor provides input to a logic circuit that toggles each ignition channel between two Hall effect sensors positioned 15 degrees apart on the timing disk.

For instance, when the cam position sensor indicates that the engine is on the first half of its 720-degree cycle, the signal from the hall effect sensor at 0 degrees is output to the electronic distributor channel driving the ignition coil on cylinders 1 and 7. Cylinder 1 is on the compression stroke, and fires. Cylinder 7 is on the beginning of its intake stroke and the spark is merely wasted. When the cam position sensor indicates that the engine is on the second half of its 720-degree cycle, the signal from the hall effect sensor at 345 degrees is passed to the ignition channel driving the same ignition coil. In this case, cylinder 7 is on its compression stroke, and fires, whereas cylinder 1 does not fire, since it is on the end of its exhaust stroke. Thus, the electronic distributor delivers the correct spark timing to the appropriate cylinder, depending on the cycle position of the engine.

The present ignition system is shown in a dual redundant configuration, and is especially useful in that configuration. However, it can also be beneficially used in a single non-redundant configuration by eliminating the elements of the secondary system shown herein.

Conceptually the offset in spark timing separation alternates between positive and negative about 120 degrees for a 12-cylinder engine, or about 1440 divided by the number of cylinders in general. The timing as shown herein starts at 0 degrees, and proceeds in a sequence of steps of 105, 135, 105, 135, . . . degrees. However, the timing can just as well follow a sequence of 135, 105, 135, 105, . . . degrees, assuming the cranks are offset in that sequence. The magnitude of the offset is a compromise between eliminating harmonic vibration in the crankshaft on the one hand, and irregular firing on the other hand. 15 degrees is an optimum offset in a 12 cylinder engine, but other offsets can be used if desired.

Although the present invention has been described herein with respect to preferred embodiments, it will be understood that the foregoing description is intended to be illustrative, not restrictive. Modifications of the present invention will occur to those skilled in the art. All such modifications that fall within the scope of the appended claims are intended to be within the scope and spirit of the present invention.

I claim:

1. A method for timing an ignition system in an internal combustion 4-cycle truly-opposed piston engine with two opposed rows of cylinders, comprising the steps of:

a) providing an ignition distribution system with half as many output leads as engine cylinders, each output lead firing two cylinders on the same row of cylinders, half of the output leads passing to each row of cylinders;

b) providing a unique repeating ignition timing signal to the distribution system for each pair of opposed cylinders, the ignition timing signals repeating on every 360-degree rotation of the engine;

c) sensing the rotational position of the engine via a rotary position sensor attached to a camshaft of the engine, and passing a signal indicating the engine rotational position to the ignition distribution system; and d) passing an alternating one of two said timing signals to each output lead on each 360-degree engine rotation to fire a respectively alternating one of said two cylinders on the same row of cylinders that is on its compression stroke depending on the rotational position of the engine;

whereby a unique timing signal is provided for each cylinder in each row of cylinders, each distributor output lead fires two cylinders in the same row of cylinders, and an alternating one of two timing signals is passed to each output lead by the ignition distribution system to fire a respectively alternating one of the two cylinders on said output lead.

2. A method for timing an ignition system in an internal combustion 4-cycle piston engine comprising the steps of:

a) providing a cam sensor disk connected to a camshaft of the engine, having a circumference, with a first half of the circumference differentiated from the second half for sensing;

b) providing an ignition timing disk connected to the crankshaft of the engine, the timing disk having a circumference with a timing mark;

c) providing sensors for sensing the timing mark, the sensors located in a sequence around the circumference of the timing disk, starting at 0 degrees, in steps of 1440 degrees divided by the number of cylinders of the engine plus a given offset on alternate steps;

d) providing an electronic distributor with an output lead for each two cylinders on the same side of the engine that are fired by respective two adjacent sensors separated by the magnitude of the offset on the timing disk; and, e) on each 360-degree rotation of the timing disk, selecting which of said respective two adjacent sensors to enable for said each two cylinders based on the position of the cam sensor disk;

whereby the spark timing for each cylinder alternates between two timings, a first timing to fire the cylinder, and a second timing to fire a second cylinder on the same side of the engine using the same distributor output lead.

3. A first ignition system for an internal combustion 4-cycle truly-opposed piston engine with two opposed rows of cylinders, comprising:

a timing disk connected to the crankshaft of the engine, rotating at the speed of the engine, and having a timing mark on its circumference;

sensors for sensing the timing mark, the sensors located in a sequence around the circumference of the timing disk, starting at 0 degrees, in steps of 1440 degrees divided by the number of cylinders of the engine plus a given offset on alternate steps;

a cam position disk connected to a camshaft of the engine, rotating at half the speed of the engine, and having 180 degrees of its circumference sensibly different from the remaining 180 degrees of its circumference;

a cam position sensor adjacent the circumference of the cam position disk that senses which half of the circumference of the cam timing disk is under the cam position sensor;

a logic circuit with input from the cam position sensor and with inputs from each of the timing mark sensors, the logic circuit providing one output for each two adjacent timing mark sensors that are separated around the circumference of the timing disk by the given offset, the logic circuit determining which one of said each two adjacent timing mark sensors to enable, depending on the position of the cam position disk; and, an electronic distributor receiving inputs the outputs from the logic circuit, and providing a respective distributor output lead for each input from the logic circuit, each distributor output lead providing an electrical signal to fire two cylinders on alternate 360-degree cycles of the engine on the same row of cylinders.

4. The first ignition system of claim 3, further comprising a first spark plug in each cylinder of the engine fired by the first ignition system, and further comprising a second ignition system on the same engine with the same elements as the first ignition system, and a second spark plug in each cylinder of the engine fired by the second ignition system.

* * * * *